US009381741B2

(12) United States Patent
Takeuchi et al.

(10) Patent No.: US 9,381,741 B2
(45) Date of Patent: Jul. 5, 2016

(54) INKJET PRINTHEAD SUBSTRATE, METHOD OF MANUFACTURING THE SAME, AND INKJET PRINTHEAD

(71) Applicant: CANON KABUSHIKI KAISHA, Tokyo (JP)

(72) Inventors: Souta Takeuchi, Fujisawa (JP); Soichiro Nagamochi, Kawasaki (JP); Shuichi Tamatsukuri, Asaka (JP); Sadayoshi Sakuma, Oita (JP); Kenji Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/794,659

(22) Filed: Jul. 8, 2015

(65) Prior Publication Data

US 2016/0009090 A1 Jan. 14, 2016

(30) Foreign Application Priority Data

Jul. 10, 2014 (JP) ..... 2014-142363

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14129* (2013.01); *B41J 2/14072* (2013.01); *B41J 2/1601* (2013.01); *B41J 2/1603* (2013.01); *B41J 2/1628* (2013.01); *B41J 2/1631* (2013.01); *B41J 2/1642* (2013.01); *B41J 2/1646* (2013.01); *B41J 2/1408* (2013.01)

(58) Field of Classification Search

CPC ..... B41J 2/14088; B41J 2/14112; B41J 2/14129; B41J 2/1404; B41J 2/14032

See application file for complete search history.

(56) References Cited

U.S. PATENT DOCUMENTS 7,390,078 B2 6/2008 Bell et al.

*Primary Examiner* — Geoffrey Mruk

(74) *Attorney, Agent, or Firm* — Canon U.S.A., Inc., IP Division

(57) ABSTRACT

An inkjet printhead substrate includes a base plate, a heat storage layer placed on the base plate, a heat-generating resistive layer which is placed on the heat storage layer and which includes an electrothermal transducing portion, a wiring layer electrically connected to the heat-generating resistive layer, and an insulating protective layer covering the heat-generating resistive layer and the wiring layer. The heat storage layer includes a porous cyclic silazane film formed by a vapor phase process.

12 Claims, 6 Drawing Sheets

INKJET PRINTHEAD SUBSTRATE, METHOD OF MANUFACTURING THE SAME, AND INKJET PRINTHEAD

BACKGROUND OF THE INVENTION

1. Field of the Invention

The present invention relates to an inkjet printhead substrate for making a record on a record medium by ejecting ink by an inkjet process, a method of manufacturing the inkjet printhead substrate, and an inkjet printhead including the inkjet printhead substrate.

2. Description of the Related Art

In recent years, thermal inkjet printheads which can be driven with low power consumption and which have high reliability have been demanded. A thermal inkjet printhead (hereinafter also simply referred to as "inkjet printhead") is mainly composed of a device substrate for printheads and a channel-forming member having an ink chamber and ink ejection ports communicating with the ink chamber. The device substrate is provided with a heat-generating resistor (electrothermal transducing portion) generating heat that is energy for bubbling ink to eject ink. The heat-generating resistor is provided with a protective layer for avoiding the contact with ink. An insulating layer is placed between the heat-generating resistor and a semiconductor substrate such as a silicon substrate. Reducing the thermal conductivity of the insulating layer, which is placed between the heat-generating resistor and the semiconductor substrate, is effective in driving the inkjet printhead with low power consumption. Hitherto, an insulating layer on a semiconductor substrate has been made of silicon oxide (hereinafter referred to as SiO). SiO has a thermal conductivity of 1.3 $Wm^{-1}K^{-1}$ and therefore cannot sufficiently prevent heat from escaping into the semiconductor substrate. This has hindered the reduction of power consumption. Therefore, an insulating layer with a thermal conductivity less than the thermal conductivity of SiO, that is, a heat storage layer is demanded.

When the thermal conductivity of the heat storage layer is low, heat generated from a heat-generating resistor is unlikely to escape toward a substrate through the heat storage layer, the temperature of a heat application portion which is placed on the heat-generating resistor and which is contacted with ink rises efficiently, and input energy necessary to bubble ink is small. As a result, a printhead capable of being driven with low power consumption can be obtained.

FIG. 5 shows a printhead disclosed in U.S. Pat. No. 7,390,078 (hereinafter referred to as "Patent Document"). In the printhead, an insulating layer 28, a heat storage layer (low-thermal diffusivity film) 32, a heat-generating resistive layer 26, a cover layer (conductive metal layer) 60, and a protective layer 30 are stacked on a semiconductor substrate 22 and the junction between the cover layer 60 and the heat-generating resistive layer 26 acts as a fluid ejector actuator 17. The insulating layer 28 is made of silicon oxide, silicon nitride, or the like. The heat storage layer 32 is made of the aerogel of a ceramic oxide such as silica, titania, or alumina. The heat storage layer 32 has a pore size of less than 100 nm and a low thermal conductivity of about 0.3 $Wm^{-1}K^{-1}$ to 1 $Wm^{-1}K^{-1}$. Therefore, the printhead can be driven with low power consumption.

SUMMARY OF THE INVENTION

The present invention provides an inkjet printhead substrate including a base plate, a heat storage layer placed on the base plate, a heat-generating resistive layer which is placed on the heat storage layer and which includes an electrothermal transducing portion, a wiring layer electrically connected to the heat-generating resistive layer, and an insulating protective layer covering the heat-generating resistive layer and the wiring layer. The heat storage layer includes a porous cyclic silazane film formed by a vapor phase process.

The present invention provides a method of manufacturing an inkjet printhead substrate. The method includes a step of forming a heat storage layer on a base plate, a step of forming a heat-generating resistive layer including an electrothermal transducing portion on the heat storage layer, a step of forming a wiring layer electrically connected to the heat-generating resistive layer, and a step of forming an insulating protective layer covering the heat-generating resistive layer and the wiring layer. The step of forming the heat storage layer includes a sub-step of forming a porous cyclic silazane film by a vapor phase process.

Furthermore, the present invention provides an inkjet printhead including the above inkjet printhead substrate and a channel-forming member which has an ink ejection port located at a position corresponding to the heat application portion and which forms a liquid channel that extends from an ink supply port, extending through the inkjet printhead substrate, to the ink ejection port through the heat application portion.

Further features of the present invention will become apparent from the following description of exemplary embodiments with reference to the attached drawings.

DESCRIPTION OF THE EMBODIMENTS

The aerogel making up the heat storage layer 32 described in Patent Document is prepared by a sol-gel process in such a manner that a material solution is subjected to a chemical reaction such as hydrolysis or polycondensation. Thereafter, the following process is used: a process in which the aerogel is applied to a substrate and is then densified in such a manner that a remaining solvent is removed by heat treatment.

However, in the above process, it is difficult to completely remove the solvent by heat treatment; hence, the solvent may possibly remain. Driving the printhead heats the heat storage layer 32 to high temperature and therefore the solvent remaining in the heat storage layer 32 may possibly be gasified. The heat storage layer 32 is expanded by the gasification of the remaining solvent and is contracted by degassing. The repetition of such expansion and contraction cracks the heat storage layer 32, whereby the heat-generating resistive layer 26, which is placed on the heat storage layer 32, is also cracked. Hence, the printhead may possibly become non-functional because of disconnection.

It is an object of the present invention to provide an inkjet printhead which can be driven with low power consumption and which has high reliability.

Embodiments of the present invention will now be described with reference to the attached drawings.

Description of Inkjet Printing Apparatus

Figure 4A:
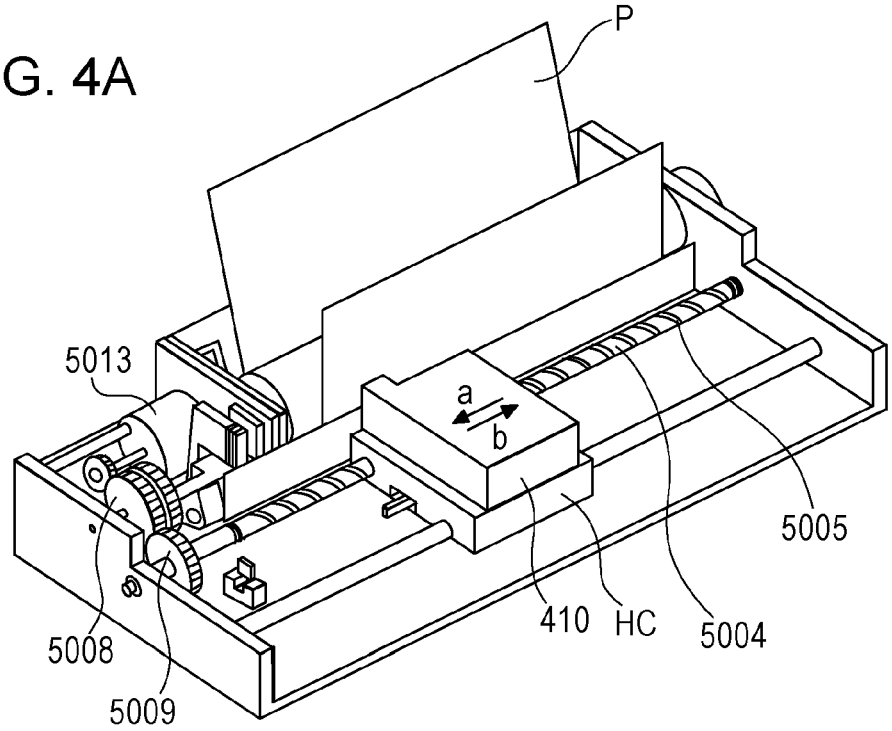
FIG. 4A is a schematic perspective view of an inkjet printing apparatus capable of carrying an inkjet printhead according to the present invention.

FIG. 4A is a schematic perspective view of an inkjet printing apparatus capable of carrying an inkjet printhead according to the present invention. As shown in FIG. 4A, a lead screw 5004 is rotated through driving force-transmitting gears 5008 and 5009 in synchronization with the forward or reverse rotation of a driving motor 5013. A carriage HC can carry an inkjet head unit 410, includes a pin (not shown) engaged in a helical channel 5005 of the lead screw 5004, and is reciprocally moved in the directions of Arrows a and b.

Description of Inkjet Printhead

Figure 4B:
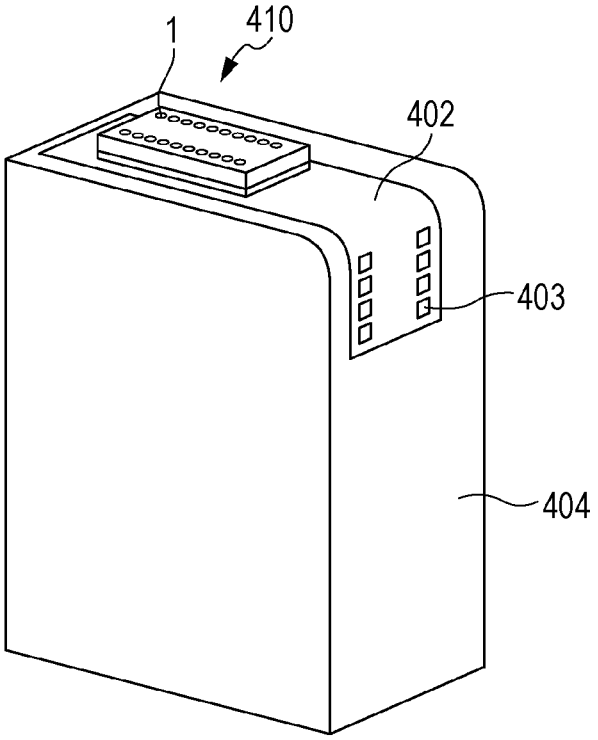
FIG. 4B is a perspective view of an example of an inkjet head unit.
Figure 4C:
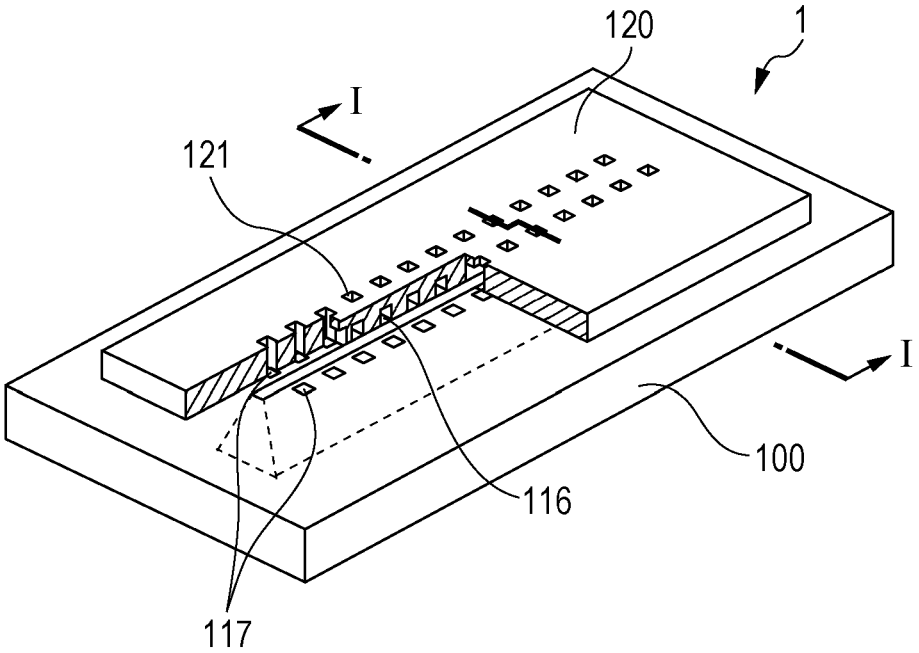
FIG. 4C is a schematic perspective view of the inkjet printhead according to the first embodiment.
Figure 5:
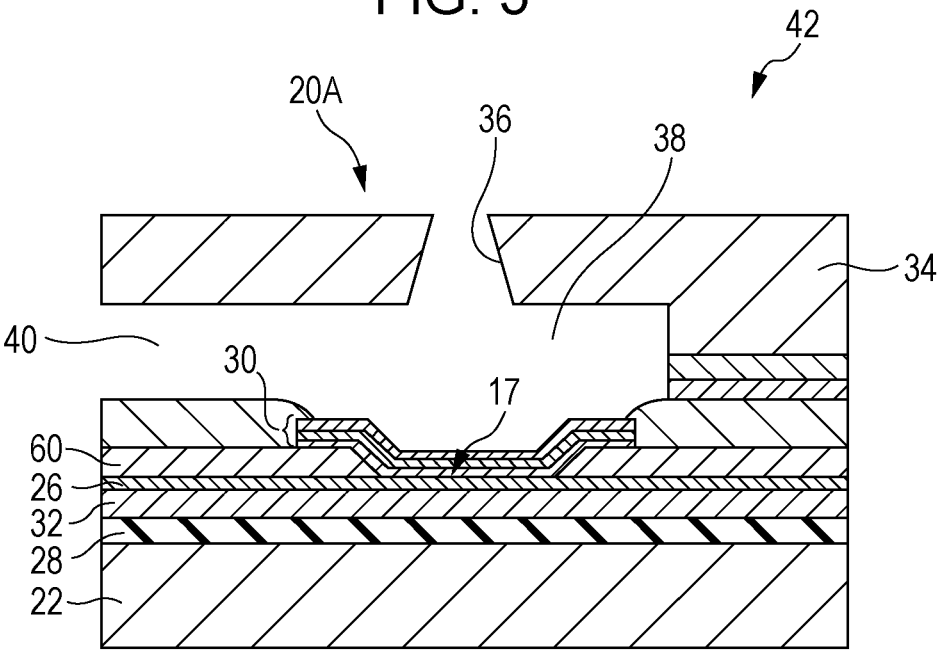
FIG. 5 is a schematic sectional view of a conventional printhead.

FIG. 4B is a perspective view of an example of the inkjet head unit 410. The inkjet head unit 410 includes an inkjet printhead 1 according to a first embodiment of the present invention and an ink storage portion 404 containing ink supplied to the inkjet printhead 1. The inkjet printhead 1 and the ink storage portion 404 are integrated to form an inkjet cartridge. The inkjet printhead 1 is placed opposite to a recording medium P shown in FIG. 4A. The inkjet printhead 1 and the ink storage portion 404 need not necessarily be integrated. The ink storage portion 404 may be detachable. Reference numeral 402 represents a tape member, including a terminal for supplying electricity to the inkjet printhead 1, for tape automated bonding (TAB). The tape member 402 can receive electricity and various signals from a printing apparatus body through contacts 403. FIG. 4C is a schematic perspective view of the inkjet printhead 1.

Figure 1A:
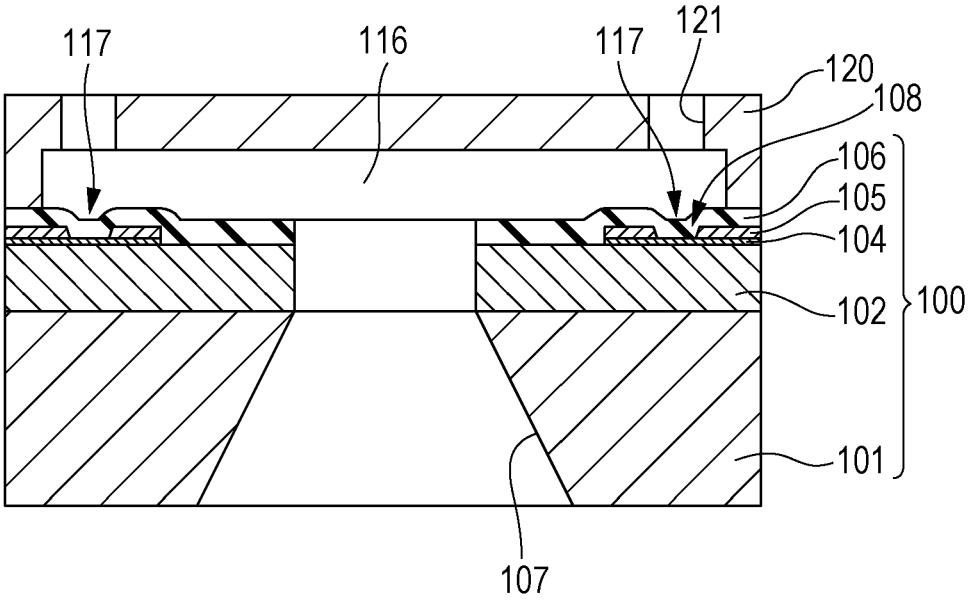
FIG. 1A shows an example of the vicinity of heat application portions of an inkjet printhead according to a first embodiment of the present invention and is a schematic vertical sectional view of the inkjet printhead taken along the line I-I of FIG. 4C.

FIG. 1A shows an example of the vicinity of heat application portions 117 of the inkjet printhead 1 and is a schematic vertical sectional view of the inkjet printhead 1 taken along the line I-I of FIG. 4C.

Referring to FIG. 1A, reference numeral 101 represents a base plate made of silicon or the like. The base plate 101 is overlaid with a heat storage layer 102 including a porous cyclic silazane film. Reference numeral 104 represents heat-generating resistive layers. Reference numeral 105 represents a wiring layer made of a metal material such as Al, Al—Si, or Al—Cu. Exposed portions of the heat-generating resistive layers 104 that are located under gaps formed by partly removing the wiring layer 105 are electrothermal transducing portions 108. The wiring layer 105 is connected to a driving element circuit, which is not shown, or an external power supply terminal and can receive electricity from outside. The wiring layer 105 is placed on the heat-generating resistive layers 104 as shown in FIG. 1A and is not limited to this configuration. For example, the following configuration may be used: a configuration in which the wiring layer 105 is formed on the base plate 101 so as to have gaps, the heat storage layer 102 is placed on the wiring layer 105, the heat-generating resistive layers 104 are placed on the heat storage layer 102, and the heat storage layer 102 is provided with contacts for electrically connecting the heat-generating resistive layers 104 to the wiring layer 105. Alternatively, the following configuration may be used: a configuration in which the wiring layer 105 is formed on the heat storage layer 102 so as to have gaps and the heat-generating resistive layers 104 are placed on portions of the heat storage layer 102 that are located on the wiring layer 105 and that are located between the gaps. That is, the wiring layer 105 may be electrically connected to the heat-generating resistive layers 104. Reference numeral 106 represents an insulating protective layer which is placed over the heat-generating resistive layers 104 and the wiring layer 105 and which includes an SiO film, an SiN film, or the like. The insulating protective layer 106 transmits heat generated from the electrothermal transducing portions 108 to the heat application portions 117 and therefore preferably has a thermal conductivity higher than that of the heat storage layer 102. Surface portions of the insulating protective layer 106 that are located above the electrothermal transducing portions 108 are the heat application portions 117.

A channel-forming member 120 is placed on an inkjet printhead substrate 100 having the above configuration. The channel-forming member 120 has ink ejection ports 121 located at positions corresponding to the heat application portions 117 and forms a liquid channel 116 which extends from an ink supply port 107, extending through the inkjet printhead substrate 100, to the ink ejection ports 121 through the heat application portions 117. The inkjet printhead 1 includes the inkjet printhead substrate 100 and the channel-forming member 120.

The heat storage layer 102 includes the cyclic silazane film. The cyclic silazane film is formed by, for example, a vapor phase process such as a plasma-enhanced chemical vapor deposition (PECVD) process. The heat storage layer 102 may include an insulating layer, made of SiO or SiN, lying on the base plate 101. In descriptions below, the cyclic silazane film is referred to as the heat storage layer 102 in some cases.

Figure 6:
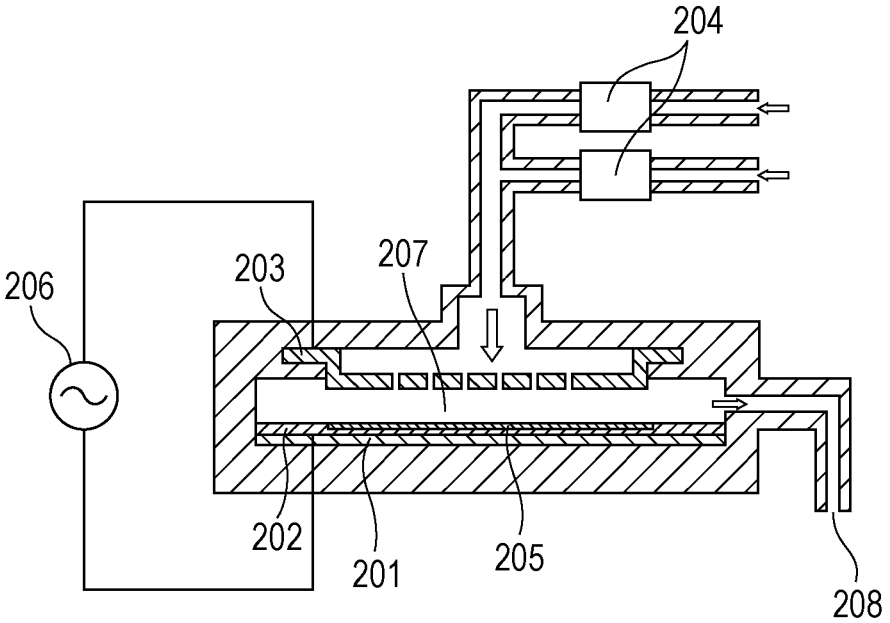
FIG. 6 is a schematic sectional view of a PECVD chamber capable of being used in a manufacturing method according to the present invention.

The PECVD process is described below with reference to FIG. 6. FIG. 6 is a schematic sectional view of a PECVD chamber. A process gas used is introduced into a deposition chamber 207 from a shower head 203. In this operation, the flow rate of the process gas is controlled by a mass flow controller 204. The deposition chamber 207 is connected to a vent 208, from which the process gas is discharged. RF power is applied to the shower head 203 and a top plate 202 from an RF power supply 206, so that radicals are generated in the deposition chamber 207 by plasma discharge. The process gas chemically reacts with atoms dissociated in the plasma or the generated radicals to form a deposit on a base plate 205, whereby a film is formed. The temperature (deposition temperature) of the top plate 202 can be varied with a heater 201. The deposition temperature is higher than or equal to room temperature (25° C.). In the case of using a base plate provided with, for example, functional elements or the like, the deposition temperature can be appropriately selected unless the functional elements are adversely affected. The deposition temperature is preferably 400° C. or lower. As the deposition temperature is high, the porosity decreases to increase the mechanical strength and the thermal conductivity tends to decrease. The porosity and the thermal conductivity are adjusted so as to be well balanced, whereby the heat storage layer 102 can be effectively formed.

Figure 2A:
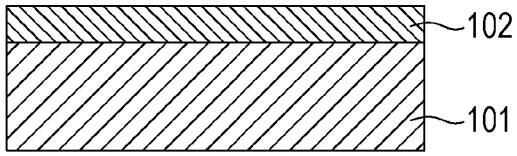
FIGS. 2A to 2E are schematic sectional views illustrating steps of manufacturing the inkjet printhead substrate shown in FIG. 1A.

In the present invention, the heat storage layer 102 is formed using a process gas (source gas) capable of forming the cyclic silazane film. Gas which is a material for forming the skeleton of cyclic silazane is introduced into the PECVD chamber shown in FIG. 6. A carrier gas used may be an inert gas such as a nitrogen gas or an argon gas. Generating plasma cleaves some of bonds of source gases, whereby the porous cyclic silazane film (heat storage layer 102) is formed so as to have a cyclic silazane skeleton as shown in FIG. 2A.

The term "cyclic silazane" as used herein is a collective term for compounds with a cyclic skeleton having a silazane unit represented by the formula —(Si—N)$_n$—, where n is an integer. The compounds may have a monocyclic structure or a polycyclic structure. The cyclic silazane film is made of a material containing a plurality of such cyclic skeletons. Herein, the bond number n of silazane units forming a cyclic skeleton is preferably 3 to 20. This is because when the bond number n is less than 3, it is difficult to form the cyclic skeleton and when the bond number n is more than 20, the mechanical strength is low and the durability to thermal stress or the like is deteriorated. The bond number n is not limited to 1. Various bond numbers n of cyclic structures may be contained.

A mixture of a silicon compound capable of supplying Si and an amine compound capable of supplying N can be used a process gas capable of forming cyclic silazane. An aminosilane compound containing both Si and N may be used. Furthermore, a compound with a cyclic silazane structure can be used a process gas. In this case, the bond number n of the silazane units can be adjusted in the stage of raw materials.

The porous cyclic silazane film, which is formed by the vapor phase process, preferably has a pore size of 0.1 nm to 3 nm. The pore size varies depending on the bond number n of the silazane units forming the cyclic skeleton or the length of linking groups linking cyclic skeletons and can be adjusted by selecting raw materials or deposition conditions in the case of using the vapor phase process.

In the vapor phase process, the composition and porosity of the cyclic silazane film vary depending on deposition conditions such as the type and flow rate of a process gas and deposition temperature. The change in porosity of the cyclic silazane film affects properties thereof. As the porosity is high, the thermal conductivity is low. As the porosity is low, the durability to thermal stress is high. That is, the thermal conductivity and the durability to thermal stress are in a trade-off relationship. In the present invention, in order to well balance the thermal conductivity and the durability to thermal stress, the porosity is preferably adjusted within a predetermined range. The porosity can be selected from the range of 20% to 70%. In particular, the porosity preferably ranges from 30% to 60%. The porosity can be adjusted by heat treatment after the cyclic silazane film is formed. The cyclic silazane film preferably has a thickness of 50 nm to 5,000 nm and more preferably 100 nm to 3,000 nm.

Figure 1B:
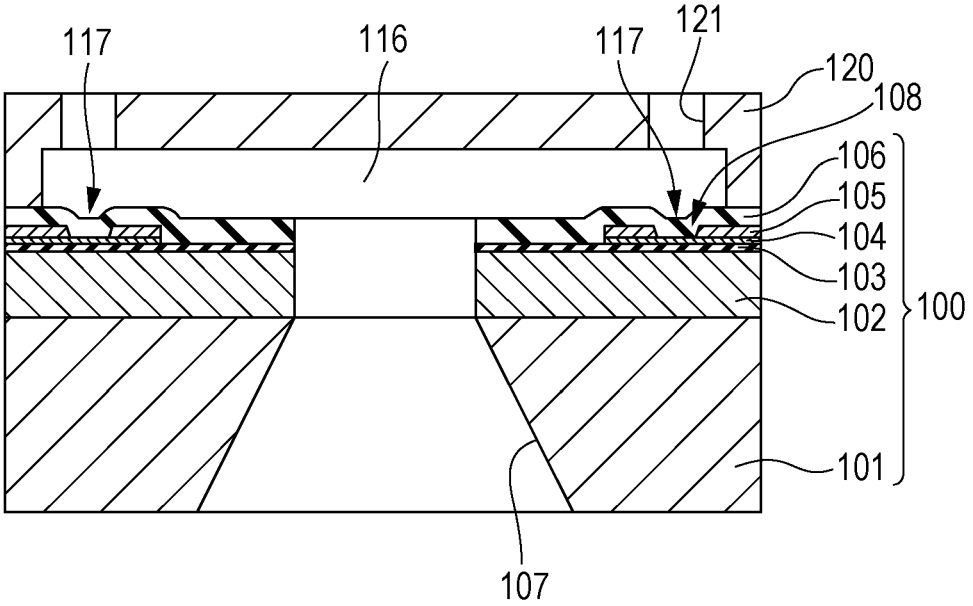
FIG. 1B is a schematic vertical sectional view of an inkjet printhead according to another embodiment of the present invention.

In the case of forming the heat-generating resistive layers 104 and the wiring layer 105 on the porous cyclic silazane film (heat storage layer 102) as described above, the flatness of the cyclic silazane film may possibly decrease depending on the size of pores in the cyclic silazane film or the thermal conductivity of the heat storage layer 102 may possibly increase because a material with high thermal conductivity enters the pores. Therefore, it is preferred that the flatness of the heat storage layer 102 is ensured and pore-sealing treatment for preventing a foreign substance from entering the pores is performed by sealing surface pores. The pore-sealing treatment is performed in such a manner that an insulating layer (also referred to as "pore-sealing film 103") such as an SiO film or a silicon nitride (SiN) film is formed on the cyclic silazane film (heat storage layer 102) as shown in FIG. 1B. The pore-sealing film 103 becomes a portion of the heat storage layer 102. Incidentally, SiN is higher in thermal conductivity than SiO. Therefore, when the thickness of a film is excessively large, thermal diffusion in a direction parallel to a surface is high. Thus, a film with a thickness of, for example, 5 nm to 50 nm can be formed such that the flatness thereof is ensured to a certain extent by pore sealing.

EXAMPLES

The present invention is further described below in detail with reference to examples. The present invention is not limited to the examples. Modifications can be made within the scope of the present invention.

Example 1

Exemplary steps of manufacturing an inkjet printhead substrate and inkjet printhead according to an embodiment of the present invention are described below.

FIGS. 2A to 2E are schematic sectional views illustrating steps of manufacturing an inkjet printhead substrate 1 as shown in FIG. 1A.

The manufacturing steps are performed for each base plate 101 made of Si or a substrate including driving elements, fabricated in advance, including semiconductor elements such as switching transistors, for selectively driving electrothermal transducing portions 108. However, for the sake of convenience, the base plate 101, which is made of Si, is shown in figures below (FIG. 2A).

A heat storage layer 102 made of cyclic silazane was formed on the base plate 101 by a vapor phase process under Deposition Conditions A, B, C, D, or E shown in Table so as to have a thickness of 0.5 μm to 2.0 μm as shown in FIG. 2A. The heat storage layer 102 was formed at an RF power of 500 W using a PECVD system shown in FIG. 6 and using 2,4,6-trimethyl-2,4,6-trivinylcyclotrisilazane represented by the following formula as a source gas:

(A)

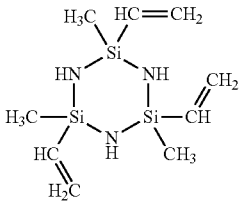

This compound is a known compound with CAS No. 5505-72-6 and is commercially available.

In cyclic silazane formed from the compound represented by Formula (A), for example, vinyl groups are radially polymerized to form a structure represented by the following formula:

(B)

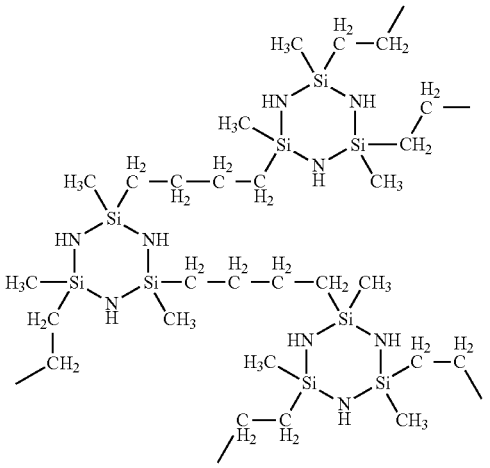

The structure represented by Formula (B) contains methyl groups bonded to Si atoms and methylene chains linking the Si atoms. The methylene chains, which link the Si atoms, are not necessarily only butylene groups formed by the polymerization of vinyl groups but also may possibly be ethylene or propylene groups formed by the elimination of some of methylene groups in plasma. As shown in Table below, as the deposition temperature is high, this tendency is significant and the pore size is small. Therefore, the porosity may probably be low. In the present invention, a cyclic silazane structure containing an alkyl group such as a methyl group in the form of a side chain and a methylene chain in the form of a linking group, that is, cyclic silazane containing a side chain and/or a linking group containing a carbon atom is denoted as SiCN. In a cyclic skeleton represented by the formula —(Si—N)$_n$—, the bond number represented by n is 3 in the case of the structure represented by Formula (B). A plurality of cyclic skeletons in which n is 3 are linked through linking groups to form macrocyclic structures. The macrocyclic structures become large-sized pores.

The heat storage layer 102 formed as described above was porous and had a pore size of 0.1 nm to 3 nm.

Next, heat-generating resistive layers 104 made of TaSiN or the like were formed on the heat storage layer 102 by reactive sputtering so as to have a thickness of about 50 nm. Furthermore, an Al layer for forming a wiring layer 105 was formed over the heat-generating resistive layers 104 so as to have a thickness of about 285 nm. The heat-generating resistive layers 104 and the wiring layer 105 were dry-etched together by photolithography. In this example, dry etching used was reactive ion etching (RIE).

Figure 2B:
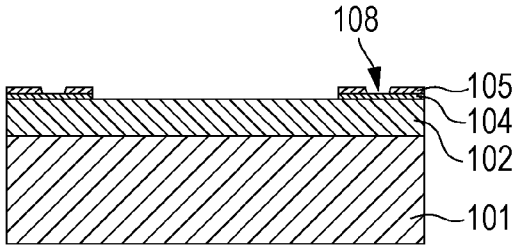

Next, in order to form electrothermal transducing portions 108, the wiring layer 105 was partly etched off by photolithography again as shown in FIG. 2B, whereby the heat-generating resistive layers 104 were partly exposed.

Figure 2C:
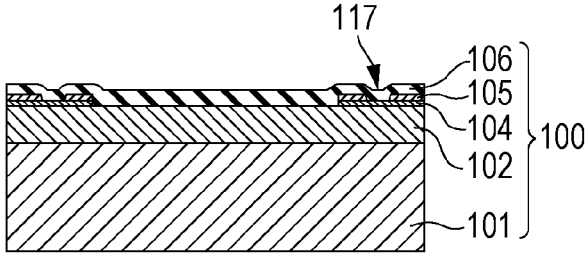

Thereafter, an insulating protective layer 106 made of SiN was formed by a PECVD process as shown in FIG. 2C so as to have a thickness of about 300 nm, whereby an inkjet printhead substrate 100 was formed.

Figure 2D:
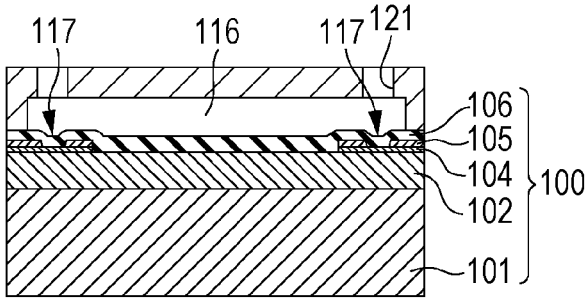
Figure 2E:
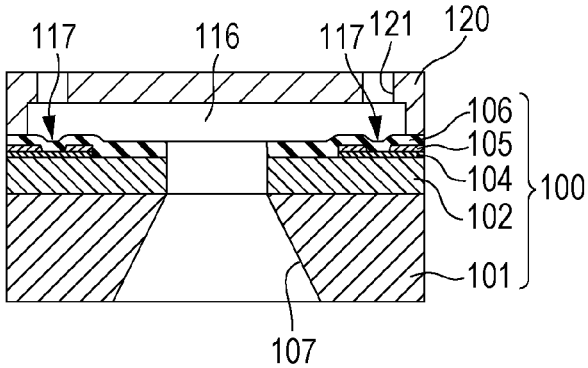

Next, a channel-forming member 120 forming a liquid channel 116 was formed on the inkjet printhead substrate 100 as shown in FIG. 2D, followed by forming ink ejection ports 121 at positions opposite to heat application portions 117. Thereafter, an ink supply port 107 was formed as shown in FIG. 2E so as to extend through the base plate 101, the heat storage layer 102, and the like and so as to communicate with the liquid channel 116. The inkjet printhead 1 was manufactured through the above steps.

The porosity of the heat storage layer 102, made of porous SiCN, formed on the base plate 101 under Deposition Conditions A, B, C, D, or E in a step shown in FIG. 2A was investigated using a transmission electron microscope. Furthermore, the thermal conductivity of the heat storage layer 102 was evaluated by a 3ω method. The evaluation results are shown in Table.

The inkjet printhead 1, which was formed through the above steps, was evaluated for durability to thermal stress using destructive pulses in such a manner that the electrothermal transducing portions 108 were driven under conditions below.

Driving frequency: 10 kHz

Driving pulse width: 2 μs

Driving voltage: 1.3 times the bubbling voltage required to eject ink.

Herein, the durability to thermal stress was rated in accordance with judgmental standards below.

A: One durable to $5.0\times10^9$ or more pulses.

B: One broken by $3.0\times10^9$ pulses to less than $5.0\times10^9$ pulses.

C: One broken by less than $3.0\times10^9$ pulses.

Furthermore, the thermal conductivity and the durability to thermal stress were comprehensively rated in accordance with judgmental standards below.

A: One which has a thermal conductivity of less than 1.00 $Wm^{-1}K^{-1}$ and which is durable to $5.0\times10^9$ or more pulses as determined by the evaluation of durability to thermal stress.

B: One which has a thermal conductivity of less than 1.00 $Wm^{-1}K^{-1}$ and which is broken by $3.0\times10^9$ pulses to less than $5.0\times10^9$ pulses or one which has a thermal conductivity of 1.00 $Wm^{-1}K^{-1}$ 1.30 $Wm^{-1}K^{-1}$ and which is durable to $5.0\times10^9$ or more pulses as determined by the evaluation of durability to thermal stress.

C: One other than the above.

The above results are summarized in Table. For comparison, the following films were also rated: an SiO film prepared by a sol-gel process described in Patent Document and a conventional SiO film prepared by a thermal CVD process using silane and oxygen.

TABLE

| Heat storage layer | | Deposition temperature (° C.) | Porosity (%) | Thermal conductivity ($Wm^{-1}K^{-1}$) | Durability to thermal stress | Comprehensive rating |
|---|---|---|---|---|---|---|
| SiO film prepared by sol-gel process described in Patent Document | | | | 0.30 | C | C |
| Conventional SiO film prepared by thermal CVD process | | | | 1.30 | A | C |
| SiCN | A | 400 | 20 | 1.16 | A | B |
| | B | 300 | 30 | 0.93 | A | A |
| | C | 200 | 40 | 0.88 | A | A |
| | D | 100 | 60 | 0.61 | A | A |
| | E | 25 | 65 | 0.42 | B | B |

In the evaluation of durability to thermal stress, the cyclic silazane films each prepared under Deposition Conditions A, B, C, or D were rated A and the cyclic silazane film prepared under Deposition Conditions E was rated B as shown in Table. These results show that the cyclic silazane films are sufficiently durable to thermal stress under all conditions. The reason why the cyclic silazane film prepared under Deposition Conditions E was rated B is probably due to the fact that the porosity thereof is high and therefore the mechanical strength thereof is low. The SiO film prepared by the sol-gel process described in Patent Document was rated C. This is probably due to the fact that heat-generating resistive layers were cracked because the SiO film was expanded and contracted by the gasification of a solvent remaining in the SiO film.

In the comprehensive rating of thermal conductivity and durability to thermal stress, the cyclic silazane films each prepared under Deposition Conditions B, C, or D were rated A and the cyclic silazane films each prepared under Deposition Conditions A or E were rated B.

The above results show that the cyclic silazane films prepared in this example are porous, are lower in thermal conductivity than the conventional SiO film prepared by the thermal CVD process, and are sufficiently durable to thermal stress. Results of the comprehensive rating show that the cyclic silazane films preferably have a porosity of 30% to 60%. That is, in the case of using the compound represented by Formula (A), the deposition temperature preferably ranges from 100° C. to 300° C. A heat storage layer according to the present invention is formed by a PECVD process that is a vapor phase process. Therefore, unlike a sol-gel process, a film contains no residual solvent. Hence, in the case of driving an inkjet printhead, concerns about degassing are little and the heat storage layer is unlikely to be expanded or contracted. Thus, the following problem is slight: a problem that a heat-generating resistor on the heat storage layer is cracked and is broken.

As described above, an inkjet printhead substrate which can be driven with low power consumption and which has high reliability is provided.

Example 2

Exemplary steps of manufacturing an inkjet printhead substrate according to another embodiment of the present invention are described below. FIGS. 3A to 3F are schematic sectional views illustrating steps of manufacturing an inkjet printhead 1 as shown in FIG. 1B.

Figure 3A:
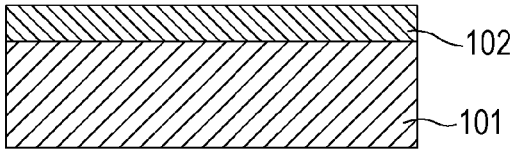
FIGS. 3A to 3F are schematic sectional views illustrating steps of manufacturing the inkjet printhead shown in FIG. 1B.
Figure 3B:
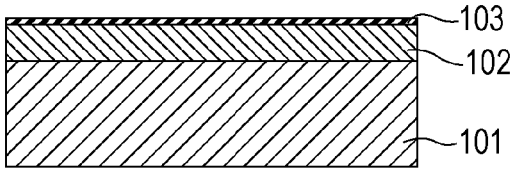
Figure 3C:
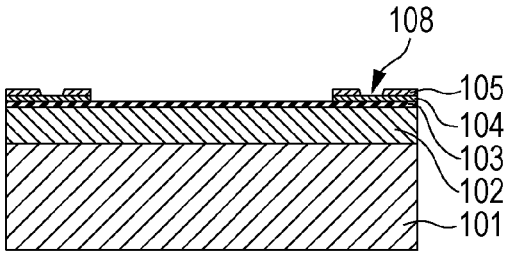
Figure 3D:
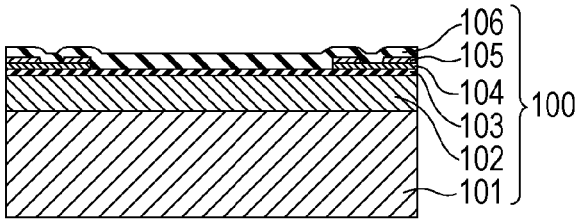
Figure 3E:
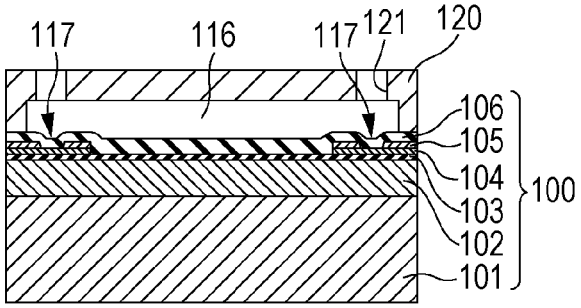
Figure 3F:
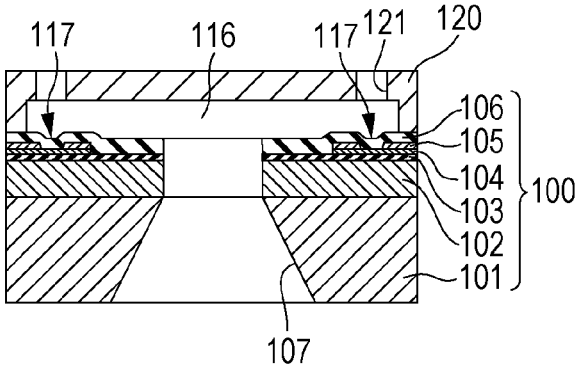

First, as shown in FIG. 3A, a heat storage layer 102 made of porous SiCN was formed on a base plate 101 in substantially the same manner as that described in Example 1. Next, as shown in FIG. 3B, an SiN film was formed on the heat storage layer 102 using a monosilane gas and an ammonia gas so as to have a thickness of 10 nm and pore-sealing treatment was performed such that surface irregularities were eliminated, whereby a pore-sealing film 103 was formed. Performing the pore-sealing treatment reduces surface irregularities of heat application portions 117 placed on an insulating protective layer 106 which is contacted with ink and which is placed on electrothermal transducing portions 108 of heat-generating resistive layers 104 formed on the pore-sealing film 103 and therefore provides the effect of reducing the diffusion of heat from the heat application portions 117 when the electrothermal transducing portions 108 are energized. The pore-sealing film 103 covers surface irregularities of the heat storage layer 102, which is made of porous SiCN, only and therefore does not affect the thermal conductivity of the whole heat storage layer 102 including the pore-sealing film 103.

Furthermore, as shown in FIGS. 3C to 3F, the heat-generating resistive layers 104, a wiring layer 105, the insulating protective layer 106, and a channel-forming member 120 forming a liquid channel 116 were formed on the pore-sealing film 103 in substantially the same manner as that described in Example 1 and a through-hole for forming an ink supply port was formed. Through the above steps, the inkjet printhead 1 was manufactured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-142363, filed Jul. 10, 2014, which is hereby incorporated by reference herein in its entirety.

What is claimed is:

1. An inkjet printhead substrate comprising:

a base plate;

a heat storage layer placed on the base plate;

a heat-generating resistive layer which is placed on the heat storage layer and which includes an electrothermal transducing portion;

a wiring layer electrically connected to the heat-generating resistive layer; and an insulating protective layer covering the heat-generating resistive layer and the wiring layer, wherein the heat storage layer includes a porous cyclic silazane film formed by a vapor phase process.

2. The inkjet printhead substrate according to claim 1, wherein the cyclic silazane film contains silazane units which form a cyclic skeleton and which are represented by the formula —(Si—N)$_n$— and the bond number n of the silazane units is 3 to 20.

3. The inkjet printhead substrate according to claim 2, wherein the cyclic silazane film is made of SiCN containing a side chain and/or linking group containing a carbon atom.

4. The inkjet printhead substrate according to claim 3, wherein the cyclic silazane film has a porosity of 30% to 60%.

5. The inkjet printhead substrate according to claim 1, wherein the heat storage layer includes the cyclic silazane film and a pore-sealing film sealing surface pores of the cyclic silazane film.

6. The inkjet printhead substrate according to claim 5, wherein the pore-sealing film is a silicon nitride film.

7. An inkjet printhead comprising:

the inkjet printhead substrate according to claim 1; and a channel-forming member which has an ink ejection port located at a position corresponding to the heat application portion and which forms a liquid channel that extends from an ink supply port, extending through the inkjet printhead substrate, to the ink ejection port through the heat application portion.

8. A method of manufacturing an inkjet printhead substrate, comprising:

a step of forming a heat storage layer on a base plate;

a step of forming a heat-generating resistive layer including an electrothermal transducing portion on the heat storage layer;

a step of forming a wiring layer electrically connected to the heat-generating resistive layer; and a step of forming an insulating protective layer covering the heat-generating resistive layer and the wiring layer, wherein the step of forming the heat storage layer includes a sub-step of forming a porous cyclic silazane film by a vapor phase process.

9. The method according to claim 8, wherein the step of forming the heat storage layer is performed by a plasma-enhanced chemical vapor deposition process using 2,4,6-trimethyl-2,4,6-trivinylcyclotrisilazane as a source gas.

10. The method according to claim 9, wherein the deposition temperature used in the plasma-enhanced chemical vapor deposition process ranges from 100° C. to 300° C.

11. The method according to claim 8, wherein the step of forming the heat storage layer includes the sub-step of forming the cyclic silazane film by the vapor phase process and a sub-step of forming a pore-sealing film sealing surface pores of the cyclic silazane film on the cyclic silazane film.

12. The method according to claim 11, wherein the pore-sealing film is a silicon nitride film.

* * * * *